United States Patent [19]

Haythornthwaite

[11] Patent Number: 4,616,828

[45] Date of Patent: Oct. 14, 1986

[54] TENNIS BALL

[76] Inventor: James Haythornthwaite, 567 Main Road, Hudson, Quebec, Canada, J0P 1J0

[21] Appl. No.: 697,237

[22] Filed: Feb. 1, 1985

[51] Int. Cl.[4] ..... A63B 39/06

[52] U.S. Cl. ..... 273/61 R; 273/58 K

[58] Field of Search ..... 273/61 R, 65 EG, 61 B, 273/61 C, 58 K, 58 B, 58 BA

[56] References Cited

U.S. PATENT DOCUMENTS

| | | | |
|---|---|---|---|
| 398,558 | 2/1889 | Waddington | 273/61 R |
| 1,240,866 | 9/1917 | Miller | 273/65 EG |
| 1,287,766 | 12/1918 | Saunders | 273/61 R |
| 1,376,778 | 5/1921 | Orr | 273/61 R |
| 2,023,672 | 12/1935 | Ellis | 273/61 R |
| 2,453,143 | 11/1948 | Lejeune | 273/61 R |
| 2,495,079 | 1/1950 | Sonnett et al. | 273/65 EG |
| 4,284,276 | 8/1981 | Worst | 273/232 |

*Primary Examiner*—George J. Marlo

*Attorney, Agent, or Firm*—Fleit, Jacobson, Cohn & Price

[57] ABSTRACT

Disclosed is a tennis ball including a continuous or discontinuous groove formed in the rubber spherical core. The groove extends about the spherical core below a track formed between two felt cover members. The groove of the spherical core controllably regularizes the air turbulence of the ball during its trajectory, and minimizes changes in air turbulence by wear or fuzzing up of the nap of the felt cover members attached to the ball. Also disclosed is an alternate embodiment for controllably regularizing the air turbulence around a tennis ball during its trajectory, using woven monofilament or multifilament synthetic fiber cover members. The diameter of the fibers and the spacing between the warp and weft fibers controls the size of exposed surface areas of the spherical core and the depth of air pockets formed between the intersecting fibers. The air pockets create a dimpled effect to control the loft or dip of the tennis ball during its trajectory. The synthetic fibers also increase the useful life of the ball, having increased strength over customary natural fibers.

16 Claims, 8 Drawing Figures

TENNIS BALL

BACKGROUND OF THE INVENTION

The comparatively short lived playing characteristics of tennis balls is a problem that has long been recognized. The problem has two major facets. There is an economic consideration of having to replace tennis balls which are clearly not playworthy because they are worn, and there is the problem of guessing as to when a ball has become so worn that its playing characteristics have been altered. Various inventors have patented different techniques for solving this problem.

U.S. Pat. No. 2,023,672 to Ellis discloses a tennis ball fabric covering having warp and weft threads made of wool yarn. A covering of loosely woven thick yarns are "floated" on top of a covering of closely woven thin yarns. In the fulling operation of the tennis ball, the yarn of the closely woven thin yarns supplies all of the fiber to compact and felt the covering. The thick yarns are arranged in a number of sguares on top of the layer of closely woven thin yarn. The pits bounded by the sguared ribs of the thick yarn are filled with felted fiber from the thin yarn. As the felted fiber from the thin yarn is removed during play, the thick yarn works up its fiber to form a fuzzy nap on the ribs. The fiber filled pits of thin yarn gradually are worn away from the surface of the cover and the thick yarns increase in fuzziness and maintain the desired nap over the covering. The thick yarns thereby constantly renew the desired fuzzy nap of the covering during the removal of the thin yarns over extended periods of play.

U.S. Pat. No. 1,376,778 to Orr discloses locating a series of circular depressions in the fabric cover of a tennis ball to keep the cover securely united with the rubber center. A sealing means used for uniting the fabric cover with the rubber center of the tennis ball is thereby protected from frictional contact with a racguet and with the ground by the depressions of the fabric cover. The circular depressions are distributed over the entire surface of the fabric cover.

U.S. Pat. No. 4,284,276 to Worst discloses a golf ball with a series of dimples and elongated grooves formed on the outer surface of the ball. The dimples and grooves interlock with complementary grooves formed on the face of a golf club. The grip on the ball by the club and "hang time" of the ball are thereby increased.

Today there is no known engineered design for a tennis ball which assists in the flight path of the ball to increase the trajectory speed and regularize control of a tennis ball during its trajectory.

A tennis ball is normally formed by covering the periphery of a rubber sphere with two dumb bell shaped pieces of felt. The felt or "melton" with which a tennis ball is covered is made of a high quality cloth including wool and nylon. The weft (transverse) yarns are made from a wool and nylon mixture which are woven with warp (longitudinal) yarns, which are cotton, in such a way that the weft yarns appear predominately on one side of the cloth. The surfaces of the felt are subject to a teasing or "raising" operation to produce a hairy surface. The hairy surface is then consolidated by a "fulling" process, in which the natural felting properties of wool are exploited by working the cloth in a soap solution to produce the necessary surface texture for the felt.

The felt is coated with a rubber solution on its reverse side and is cut into dumb bell shape covers, two of which are used to cover the spherical surface of a rubber core of the tennis ball. The dumb bell shape covers are usually applied by hand to a rubber core with a reguired degree of stretching. The amount of stretching is carefully controlled so that a complementary fit between the two dumb bell shape pieces of felt is obtained leaving a track of substantially constant width between the two covers. Rubber cement applied to the edges of the dumb-bell shape pieces of felt becomes vulcanized in a further molding operation in which a plurality of balls are heated in spherical molds. A steaming operation again raises the nap on the outer surface of the felt and the finished tennis balls are tested for deformation under a load.

During the securing of the covers to the core, a track is formed between the two covers, spacing the covers away from each other and revealing a narrow surface strip of the rubber core. Due to the thickness and fitting together of the dumb-bell shape felt covers, the depth of the space between the two covers along the track can vary.

During tennis play, dependent upon the court surface, the felt covers of the core fuzz up and wear away. The change in the surface texture of the felt cover members creates various uncontrolled air turbulences around the ball during flight. The effect of the uncontrolled air turbulences on the ball causes the ball to loft or dip more or less than desired by the player. The uncontrolled air turbulences will also affect the speed of the ball along its trajectory. Present day use of tennis balls on hard surface courts, instead of grass courts, increases the amount of wear on the cover members of a tennis ball and decreases the playing life of a ball.

SUMMARY OF THE INVENTION

By the present invention, the rubber core of a tennis ball includes a groove, extending either continuously or discontinuously, along the exposed narrow strip of the core located between the edges of two felt cover members which are applied to the outer surface of the rubber core of the tennis ball.

The air turbulence around such a tennis ball during flight is dependent on the characteristics of the groove in the rubber core. Any effect on the air turbulence by the nap of the felt cover members of the tennis ball is thereby minimized. The air turbulence effect on the ball during flight can thereby be controlled by pre-engineering the depth, width and length of the groove machined or moulded into the rubber core. The previously uncontrolled effect on the air turbulence of the tennis ball caused by the wearing away or fuzzing up of the felt cover members is minimized.

In an alternate embodiment of the present invention, the cover members are made of woven man-made monofilament or multifilament synthetic fibers. The fibers are woven in a pattern that controls the air turbulence on a tennis ball similar to the controlling effect of a golf ball having dimples. According to the diameter of the fibers and the spacing between the fibers, the air turbulence of a tennis ball is controlled. Man-made monofilament fibers also produce a better wearing surface for the cover members of a tennis ball than the natural fibers presently used for the felt cover members of a tennis ball.

The man-made monofilament or multifilament fiber cover members are also useable with the embodiment of the tennis ball having a groove in the surface of the rubber core of the tennis ball as disclosed for felt cover member tennis balls.

It is an object of the present invention to control air turbulence on a tennis ball during its trajectory.

It is a further object of the present invention to form a groove in a rubber spherical core of a tennis ball below the track formed between two cover members to control air turbulence on a tennis ball.

It is a still further object of the present invention to form either continuous or discontinuous grooves in a rubber spherical core of a tennis ball below the track formed between two spaced apart cover members.

It is a further object of the present invention to form the cover members of a tennis ball from woven synthetic fibers forming air pockets therebetween to control air turbulence around a tennis ball.

It is a still further object of the present invention to regulate the size of the air pockets formed between the warp and weft fibers by changing the diameter of the warp and weft synthetic fibers and by changing the spacing between the warp and weft synthetic fibers to control air turbulence around a tennis ball.

DETAILED DESCRIPTION OF THE PREFERRED EMBODIMENTS

Figure 1:
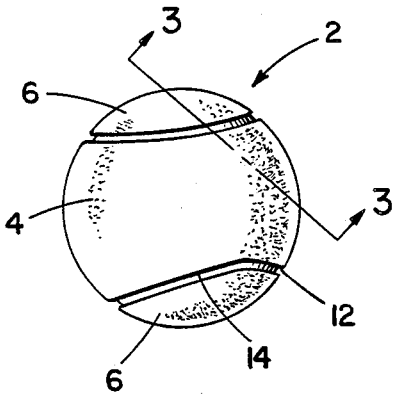
FIG. 1 is a side view of a tennis ball having a groove in the surface of the rubber core which is seen along the track between two cover members.
Figure 2:
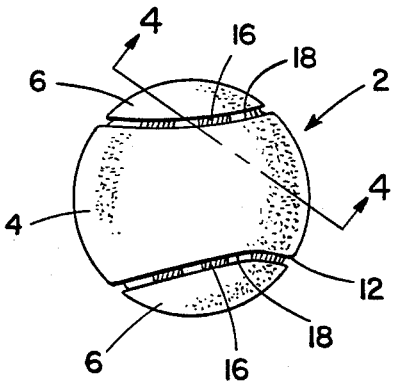
FIG. 2 is a side view of a tennis ball having a discontinuous groove in the surface of the rubber core which is seen along the track between two cover members.

In FIGS. 1 and 2, tennis ball 2 is shown. Tennis ball 2 includes two cover members 4 and 6. Cover members 4 and 6 are of identical shape. Cover member 6 extends from the top of the ball shown in FIGS. 1 and 2, down along the back side (not shown) of the ball and extends forwardly at the bottom of the ball. Cover member 4 extends across the front of the ball, around both sides of the ball and partially across the back (not shown) of the ball. Cover members 4 and 6, made of felt, are spaced from each other along a continuous track 12 through which the outer surface of the rubber core of the tennis ball is seen.

Figure 3:
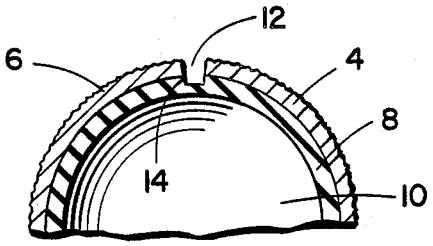
FIG. 3 is a sectional view taken along the line 3—3 shown in FIG. 1.
Figure 4:
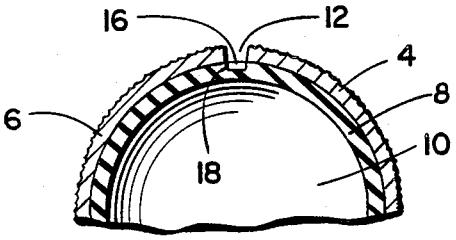
FIG. 4 is a sectional view taken along the line 4—4 shown in FIG. 2.

Two hemispherical shells are glued together to form rubber core 8. The core is pressurized with air or gas to 10 to 12 psi above atmospheric pressure. Hollow central area 10 is located within rubber core 8. As shown in FIGS. 3 and 4, cover members 4 and 6 are secured to rubber sphere 8.

Between the edges of cover members 4 and 6 is formed track 12, exposing the surface of the rubber core 8. In the present invention, the exposed surface of the rubber core 8 further includes a groove 14 machined or moulded partially into the surface of the rubber core 8. The groove 14 is located in the surface of the rubber core along the contour of the track 12 between the cover members 4 and 6.

In FIG. 2, cover members 4 and 6, each partially surround the tennis ball 2 in the same way as shown in FIG. 1. Groove 14 defined below the track 12, between the edges of the cover members 4 and 6, includes core portions 16 alternating with discontinuous groove portions 18. Discontinuous groove portions 18 are machined or moulded into the surface of the rubber core, as shown in FIG. 3. Between the groove portions 18 are core portions 16 which form part of the outer surface of the rubber core 8. The discontinuous groove portions extend along the curvature of the track 12 which is formed between the edges of the cover members 4 and 6. The alternating depressed and surface level sections of the core control the air turbulence effects on the tennis ball.

By controlling the depth and length of the groove 14 and discontinuous groove portions 18 formed in the rubber core 8 below the track 12 of the tennis ball 2, the turbulence effecting the ball during its trajectory is controlled. The effects on turbulence of the ball, previously effected by the fuzzing up from the nap of the felt cover members or the wearing down of the felt, are now controlled predominantly by the groove or discontinuous groove portions formed in the core of the ball. Therefore, the play characteristics of the tennis ball change only slightly, if perceptably at all, by the wearing away or the fuzzing up of the felt cover members.

Figure 5:
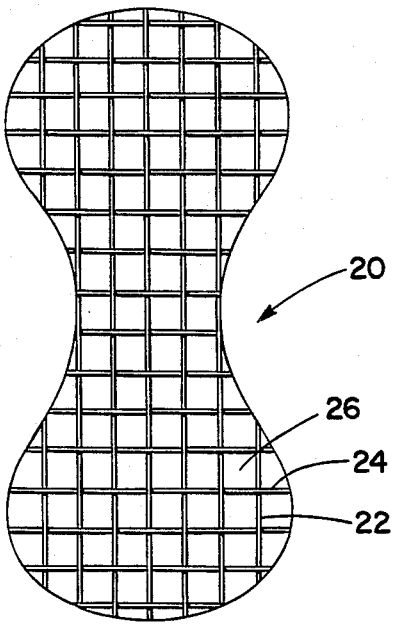
FIG. 5 illustrates a cover member made of woven man-made fibers.
Figure 6:
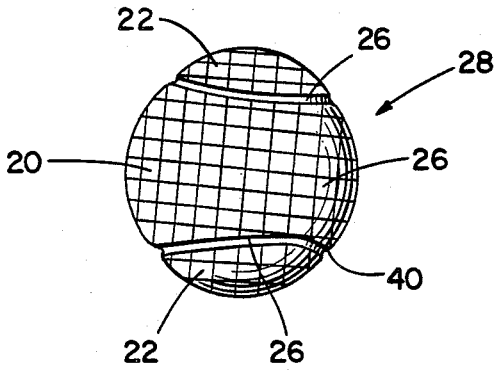
FIG. 6 illustrates a tennis ball including two cover members which are the same as the cover member shown in FIG. 5.
Figure 7:
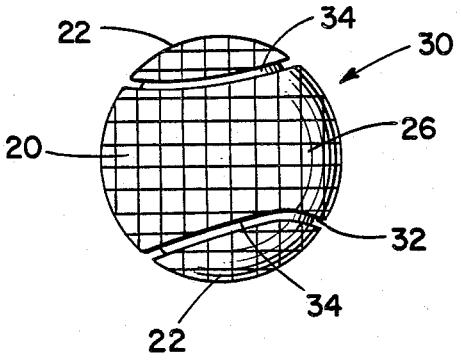
FIG. 7 illustrates a tennis ball having two cover members which are the same as the cover member shown in FIG. 5 and having a groove in the surface of the rubber core as shown in FIG. 1.
Figure 8:
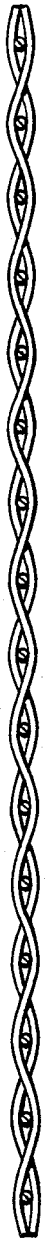
FIG. 8 is a cross sectional view of the cover member shown in FIG. 5.

An alternate embodiment for controlling the turbulence of a tennis ball in its trajectory, is shown in FIGS. 5 through 7. In FIG. 5, a single cover member 20 is shown. Two cover members are reguired to cover a rubber core of a tennis ball as shown in FIGS. 6 and 7. In FIG. 6, the cover members shown in FIGS. 1 and 2 are used, and in FIG. 7, the rubber core used in FIG. 1 is used.

In FIG. 5, monofilament or multifilament man made fibers are interwoven. The warp fibers 22 and the weft fibers 24 form sguare or rectangular areas therebetween defining air pockets 26. The surface area and depth of the air pockets 26 are controlled by varying the diameters of the warp and weft fibers and varying the spacing between the warp and weft fibers.

In a golf ball, the dimple pattern moulded into the surface is designed to produce back spin to the ball upon contact of a club with the ball. Although the ball is projected forwardly, it is caused to spin about a horizontal axis so that the top of the ball is moving against the direction in which the ball is travelling. The air flow over top of the ball is therefore sped up and the air flow below the ball is retarded. This produces a local reduction of air pressure immediately above the ball and an increase in air pressure immediately below the ball such that an upward force, or a lift, occurs. The dimple pattern controls the degree of lift generated by influencing the interaction between the ball surface and the air flow, and also affects the drag experienced by the ball in moving through the air. The distance the ball travels through the air is therefore directly dependent on the dimple pattern.

The cover member 20 shown in FIGS. 5 and 6, is secured to a spherical rubber core of the tennis ball in FIG. 6 with a second cover 22 which is identical to cover member 20. Seam 40 is located between the edges of the cover members 20 and 22. Exposed air pocket areas 26 of the rubber core of the tennis ball 28, are shown in FIG. 6.

Based on the spacing of the weave of the cover members and the diameter of the threads used, the turbulence caused by the air pockets formed between adjacent warp and weft fibers results in improved control of the air turbulence affecting the flight of a tennis ball. The air pockets control the turbulence around the ball significantly more than the seam 40 formed between the two cover members.

In FIG. 7, cover members 20 and 22 are secured to the rubber core of tennis ball 30. Track 32 is formed between the edges of the cover members 20 and 22. A continuous groove 34 is machined or moulded in the surface of the rubber core of the tennis ball 30. This is similar to groove 14 shown in tennis ball 2 in FIG. 1. A discontinuous groove (not shown) may be used between the cover members 20 and 22, similiar to the discontinous groove shown in FIG. 2. The woven synthetic fibers shown in FIG. 5 are shown in FIG. 7 surrounding the tennis ball 30, except for the exposed continuous groove 34 formed in the rubber core of the tennis ball.

In FIG. 7, the air pockets 26 exposing the surface of the rubber core control the turbulence of the ball in its trajectory resulting in control of the magnitude of the loft or dip of the ball. An improved wearing surface also is provided by the synthetic fibers forming the cover members. The groove 34 defined below the track 32 located between the edges of the cover members 20 and 22 is also used for predetermining the effect of turbulence on the trajectory of the tennis ball. The combination of the groove 34, with the woven synthetic fiber pattern of the cover members 20 and 22, greatly enhances the predetermined effect of turbulence on a tennis ball during its trajectory.

Modifications of this invention will be known to those skilled in the art. Therefore, it is to be understood that this invention is not limited to the particular embodiments disclosed, but that it is intended to cover all modifications which are within the true spirit and scope of this invention as claimed.

I claim:

1. A tennis ball comprising:

a hollow spherical core;

two cover members having peripheral edges secured to said core and being spaced from one another along said edges; and a groove in an outer peripheral surface of said spherical core, said groove being in alignment with and below said edges of said two cover members for controlling air turbulence around said tennis ball during its trajectory.

2. A tennis ball as claimed in claim 1, wherein said groove extends continuously about said outer peripheral surface of the spherical core.

3. A tennis ball as claimed in claim 1, wherein said groove extends partially about said outer peripheral surface of the spherical core.

4. A tennis ball as claimed in claim 1, wherein the spacing between said two cover members in constant about the spherical core.

5. A tennis ball comprising:

a hollow spherical core;

two cover members having spaced apart peripheral edges, said two cover members being secured to an outer peripheral surface of said spherical core and substantially surrounding said spherical core, each of said two cover members including synthetic fibers, said synthetic fibers extending at right angles toeach other and being sufficiently spaced from each other to expose portions of said outer peripheral surface of said spherical core for controlling air turbulence around said tennis ball during its trajectory.

6. A tennis ball as claimed in claim 5, wherein said fibers are monofilament.

7. A tennis ball as claimed in claim 6, wherein the diameters of said fibers are identical.

8. A tennis ball as claimed in claim 6, wherein the diameters of said fibers are different.

9. A tennis ball as claimed in claim 5, wherein said fibers are multifilament.

10. A tennis ball as claimed in claim 9, wherein the diameters of said fibers are identical.

11. A tennis ball as claimed in claim 9, wherein the diameters of said fibers are different.

12. A tennis ball as claimed in claim 5, wherein the dimensions of the exposed portions of said outer peripheral surface are different due to different diameters of said synthetic fibers and different amounts of spacing between said synthetic fibers.

13. A tennis ball as claimed in claim 5, wherein said sythetic fibers are interwoven.

14. A tennis ball comprising:

a hollow spherical core;

two cover members having spaced apart peripheral edges, said two cover members being secured to an outer peripheral surface of said spherical core and being spaced from one another along their edges, each of said two cover members including synthetic fibers, said synthetic fibers extending at right angles to each other and being sufficiently spaced from each other to expose portions of said outer peripheral surface of said spherical core for controlling air turbulence around said ball during its trajectory; and a groove in said outer peripheral surface of said spherical core, said groove being in alignment with and below said edges of said two cover members for further controlling air turbulence around said tennis ball during its trajectory.

15. A tennis ball as claimed in claim 14, wherein the dimensions of the exposed portions of said outer peripheral surface are different due to different diameters of said synthetic fibers and different amounts of spacing between said synthetic fibers.

16. A tennis ball as claimed in claim 14, wherein said synthetic fibers are interwoven.

* * * * *